US009169846B2

(12) United States Patent
Mariotti et al.

(10) Patent No.: US 9,169,846 B2
(45) Date of Patent: Oct. 27, 2015

(54) MID-SPAN GAS BEARING

(75) Inventors: Gabriele Mariotti, Florence (IT); Massimo Camatti, Pistoia (IT); Bugra Han Ertas, Houston, TX (US); Sergio Palomba, Florence (IT)

(73) Assignee: Nuovo Pignone S.P.A., Florence (IT)

( * ) Notice: Subject to any disclaimer, the term of this patent is extended or adjusted under 35 U.S.C. 154(b) by 703 days.

(21) Appl. No.: 13/516,393

(22) PCT Filed: Dec. 10, 2010

(86) PCT No.: PCT/EP2010/069347

§ 371 (c)(1),
(2), (4) Date: Sep. 14, 2012

(87) PCT Pub. No.: WO2011/080047

PCT Pub. Date: Jul. 7, 2011

(65) Prior Publication Data

US 2013/0195609 A1 Aug. 1, 2013

(30) Foreign Application Priority Data

Dec. 17, 2009 (IT) ..... CO2009A0067

(51) Int. Cl.

| | |
|---|---|
| ***F04D 29/056*** | (2006.01) |
| ***F04D 29/057*** | (2006.01) |
| ***F04D 29/059*** | (2006.01) |
| ***F04D 29/10*** | (2006.01) |

(52) U.S. Cl.

CPC ..... *F04D 29/056* (2013.01); *F04D 29/057* (2013.01); *F04D 29/059* (2013.01); *F04D 29/102* (2013.01)

(58) Field of Classification Search

None

See application file for complete search history.

(56) References Cited

U.S. PATENT DOCUMENTS

| | | | | |
|---|---|---|---|---|
| 5,066,144 | A | 11/1991 | Ide | |
| 5,102,237 | A | 4/1992 | Ide | |
| 2003/0021681 | A1 * | 1/2003 | Gregory | 415/198.1 |

FOREIGN PATENT DOCUMENTS

| | | | |
|---|---|---|---|
| CN | 1058457 | A | 2/1992 |
| CN | 1063747 | A | 8/1992 |
| EP | 2009286 | A1 * | 12/2008 |
| JP | 7208456 | A | 8/1995 |
| JP | 10061592 | A | 3/1998 |
| JP | 2003293987 | A | 10/2003 |
| KZ | 8077 | A | 10/1999 |
| WO | WO 2007110281 | A1 * | 10/2007 |
| WO | 2008018800 | A1 | 2/2008 |

OTHER PUBLICATIONS

Unofficial English translation of CN Office Action issued in connection with corresponding CN Application No. 201080064076.0 on Jul. 21, 2014.

(Continued)

*Primary Examiner* — Dwayne J White
*Assistant Examiner* — Justin Seabe
(74) *Attorney, Agent, or Firm* — GE Global Patent Operation

(57) ABSTRACT

A centrifugal compressor includes a rotor assembly with a shaft and a plurality of impellers, bearings located at ends of the shaft and configured to support the rotor assembly, a sealing mechanism disposed between the rotor assembly and the bearings, and a gas bearing disposed between the plurality of impellers for supporting the shaft and receiving a working gas from an impeller downstream from a location of the gas bearing.

20 Claims, 3 Drawing Sheets

(56) References Cited

OTHER PUBLICATIONS

"Principle of Centrifugal Compressor", Turbocompressor Teaching and Research Department of Xi'an Jiao Tong University, p. 6, China Machine Press, First Version, Sep. 30, 1980.

Unofficial English translation of KZ Office Action dated Nov. 19, 2013 from corresponding Application No. 2012/1574.1.

Unofficial English translation of Japanese Office Action issued in connection with corresponding JP Application No. 2012-543624 on Nov. 18, 2014.

Italian Search Report and Written Opinion dated Aug. 18, 2010 which was issued in connection with Italian Patent Application No. CO2009A000067 which was filed on Dec. 17, 2009.

International Search Report dated Jul. 7, 2011 which was issued in connection with PCT Patent Application No. EP10/069347 which was filed Dec. 10, 2010.

* cited by examiner

MID-SPAN GAS BEARING

CROSS REFERENCE TO RELATED APPLICATIONS

This is a national stage application under 35 U.S.C. §371 (c) prior-filed, co-pending PCT patent application serial number PCT/EP2010/069347, filed on Dec. 10, 2010, which claims priority to Italian Patent Application No. CO2009A000067, filed on Dec. 17, 2009, the entire contents of which are incorporated herein by reference.

BACKGROUND OF THE INVENTION

1. Field of the Invention

Embodiments of the present invention relate generally to compressors and, more specifically, to a mid-span gas bearing in a multistage compressor.

2. Description of the Prior Art

A compressor is a machine which increases the pressure of a compressible fluid, e.g., a gas, through the use of mechanical energy. Compressors are used in a number of different applications and in a large number of industrial processes, including power generation, natural gas liquification and other processes. Among the various types of compressors used in such processes and process plants are the so-called centrifugal compressors, in which the mechanical energy operates on gas input to the compressor by way of centrifugal acceleration, for example, by rotating a centrifugal impeller.

Centrifugal compressors can be fitted with a single impeller, i.e., a single stage configuration, or with a plurality of centrifugal stages in series, in which case they are frequently referred to as multistage compressors. Each of the stages of a centrifugal compressor typically includes an inlet volute for gas to be compressed, a rotor which is capable of providing kinetic energy to the input gas and a diffuser which converts the kinetic energy of the gas leaving the impeller into pressure energy.

A multistage compressor 100 is illustrated in FIG. 1. Compressor 100 includes a shaft 120 and a plurality of impellers 130-136 (only three of the seven impellers are labeled). The shaft 120 and impellers 130-136 are included in a rotor assembly that is supported through bearings 150 and 155.

Each of the impellers 130-136, which are arranged in sequence, increase the pressure of the process gas. That is, impeller 130 may increase the pressure from that of gas in inlet duct 160, impeller 131 may increase the pressure of the gas from impeller 130, impeller 132 may increase the pressure of the gas from impeller 131, etc. Each of these impellers 130-136 may be considered to be one stage of the multistage compressor 100.

The multistage centrifugal compressor 100 operates to take an input process gas from inlet duct 160 at an input pressure ($P_{in}$), to increase the process gas pressure through operation of the rotor assembly, and to subsequently expel the process gas through outlet duct 170 at an output pressure ($P_{out1}$) which is higher than its input pressure. The process gas may, for example, be any one of carbon dioxide, hydrogen sulfide, butane, methane, ethane, propane, liquefied natural gas, or a combination thereof.

The pressurized working fluid within the machine (between impellers 130 and 136) is sealed from the bearings 150 and 155 using seals 180 and 185. A dry gas seal may be one example of a seal that can be used. Seals 180 and 185 prevent the process gas from flowing through the assembly to bearings 150 and 155 and leaking out into the atmosphere. A casing 110 of the compressor is configured so as to cover both the bearings and the seals, and to prevent the escape of gas from the compressor 100.

While additional stages can provide an increase in the ratio of output pressure to input pressure (i.e. between inlet 160 and outlet 170), the number of stages cannot simply be increased to obtain a higher ratio.

An increase in the number of stages in a centrifugal compressor leads to multiple problems. The bearings which support the shaft are outside a sealed area that includes the impellers. An increase in the number of stages necessitates a longer shaft. A longer shaft cannot be safely supported by the bearings for the same operating speed, which become further apart as the shaft length increases making the shaft more flexible.

As the rotor assembly gets longer, the shaft becomes flexible therefore decreasing the rotor natural frequencies. When operating at higher speeds, the decrease in the fundamental natural frequencies of the rotor assembly tends to make the system more susceptible to rotor-dynamic instability, which can limit the operating speed and output of the machine.

The other issue is the forced response due to synchronous rotor imbalance. When the operating speed coincides with a rotor natural frequency, the machine is defined to be operating at a critical speed, which is a result of rotor imbalance. The compressor must pass through several of these natural frequencies or critical speeds before reaching the design operating speed.

As the compressor passes through critical speeds, the vibration amplitude of the rotor must be bounded by damping from bearings. However, with a long shaft, the majority of the rotor-dynamic energy is transferred to bend the rotor instead of energy dissipation at the bearings. This results in low damped rotor modes and high amplification factors at rotor resonances that can lead to casing and impeller rubs and even catastrophic failure of the machine.

At higher speeds past the rotor critical speeds, fluid induced forces are generated between the rotor assembly and the casing (i.e. fluid induced rotor dynamic instability). These pulsations, stemming from fluid forces can excite destructive or even catastrophic vibrations if not adequately dampened. Rotor-dynamic instability is a different mechanism from critical speeds or imbalance response and often time is much more difficult to address.

It would be desirable to design and provide a multistage centrifugal compressor which includes additional stages without increasing the diameter of the shaft and other design parameters that would drastically change the size and cost of the machine.

BRIEF SUMMARY OF THE INVENTION

Systems and methods according to these exemplary embodiments provide for an increase in the number of stages in a centrifugal compressor while overcoming problems typically associated with such an increase.

According to an exemplary embodiment, a centrifugal compressor includes a rotor assembly having a shaft and a plurality of impellers, a pair of bearings located at ends of the shaft and configured to support the rotor assembly, a sealing mechanism disposed between the rotor assembly and the bearings, and a first gas bearing disposed between the plurality of impellers and configured to support the shaft. The first gas bearing receives a working gas from an impeller located downstream from the location of the first gas bearing.

According to another exemplary embodiment, a method of processing a working gas in a centrifugal compressor includes providing the working gas to an inlet duct of the compressor, processing the gas through a plurality of compression stages with each stage increasing the speed of the gas, bleeding a portion of the accelerated gas after a stage that is downstream from a midway point of the compression stages, providing the bled gas to a bearing, reintroducing the gas from the bearing to the working gas flowing in the compressor, and expelling the working gas from an outlet duct of the compressor.

According to a further embodiment, a centrifugal compressor includes a rotor assembly having a shaft and a plurality of impellers, a pair of bearings located at ends of the shaft and configured to support the rotor assembly, a sealing mechanism disposed between the rotor assembly and the bearings, and a plurality of gas bearings disposed between the plurality of impellers and configured to support the shaft. The gas bearings receive a working gas from respective impellers located downstream from a location of the gas bearings.

BRIEF DESCRIPTION OF THE DRAWINGS

The accompanying drawings illustrate exemplary embodiments, wherein.

DETAILED DESCRIPTION

The following detailed description of the exemplary embodiments refers to the accompanying drawings. The same reference numbers in different drawings identify the same or similar elements. Also, the following detailed description does not limit the invention. Instead, the scope of the invention is defined by the appended claims.

In exemplary embodiments, a mid-span bearing may be utilized to provide additional stiffness to the rotor assembly with a longer shaft to overcome the critical speed issue highlighted above. Such a bearing makes the rotor assembly less flexible and therefore allows the rotor-dynamic energy (due to synchronous rotor imbalance forces) to be transmitted to the bearings.

This three-bearing configuration increases the damping in the rotor modes and lowers amplification factors as the rotor traverses through the critical speed allowing for safe operation of the rotor assembly. A mid-span bearing may, therefore, be provided within the casing for facilitating an increased number of stages (i.e. longer shaft) and overcoming the rotor dynamic instability.

Surface speed of a shaft (such as shaft 120) is a function of its diameter. The diameter in the middle portion of the shaft is greater than the diameter at the end portions. The difference in speeds between these portions (i.e. between middle and end) may be in the order of 2 to 3 times. Therefore, the surface speed of a shaft is greater (by a factor of 2 to 3) at the center portion of the shaft than it is at the end portions.

Figure 1:
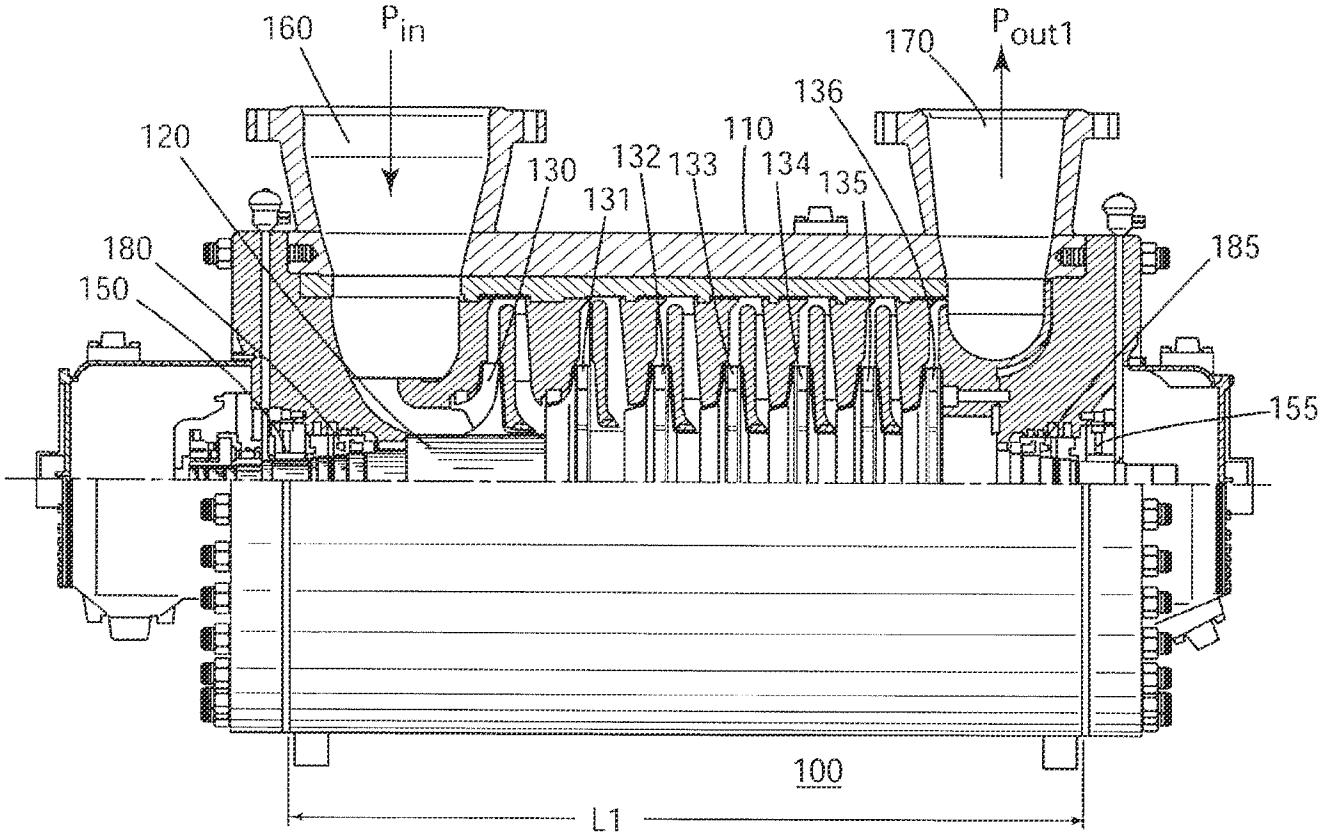
FIG. 1 Background Art
FIG. 1 illustrates a multistage centrifugal compressor.

Bearings, such as bearing 150 and 155 of FIG. 1, may typically be oil bearings. Oil bearings, however, are limited to usage where surface speed is typically closer to the surface speed at end portions of the shaft.

A mid-span bearing according to exemplary embodiments may be a gas bearing. Gas bearings can be used where surface speed is closer to the surface speeds at middle portions of a shaft.

In existing systems, highly corrosive working fluids such as hydrogen disulfide can damage conventional oil lubricated journal bearings. Such damage, greatly limits the life of the machine as oil lubricated bearings are not resistant to corrosive gases. A process gas lubricated bearing, however, does not require such sealing and can operate even in this corrosive environment while maintaining the life of the machine.

In addition to having ultra high surface speed viscous fluid capability, there is negligible power loss with gas bearings relative to oil bearings. Oil bearings also require sealing systems for preventing leakage of oil into the gas being processed by the compressor. Gas bearings obviate this need for sealing systems.

Figure 2:
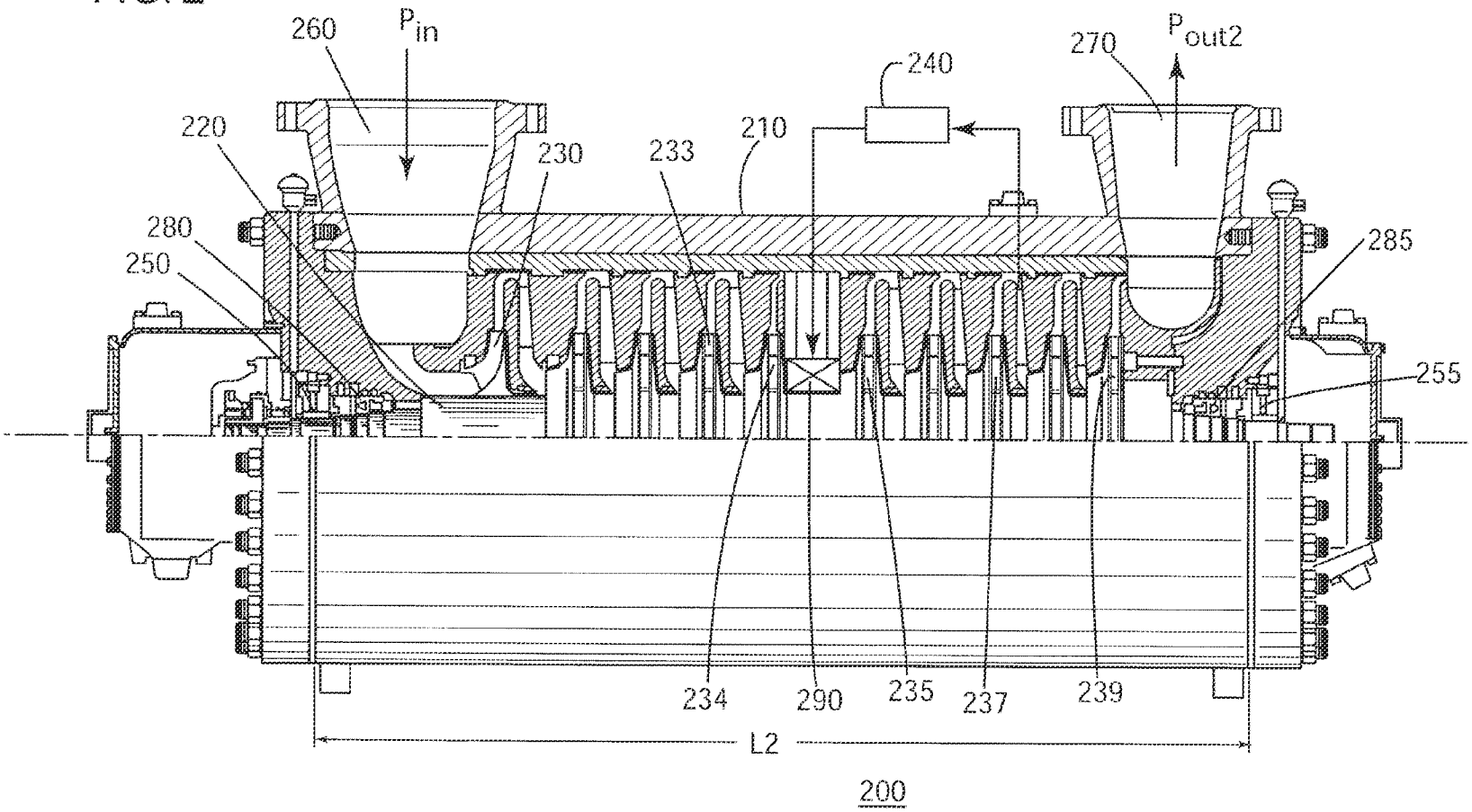
FIG. 2 illustrates a multistage centrifugal compressor according to exemplary embodiments.

FIG. 2 illustrates a compressor according to exemplary embodiments. Compressor 200 includes a shaft 220, a plurality of impellers 230-239 (only some of these impellers are labeled), bearings 250 and 255, seals 280 and 285, inlet duct 260 for taking an input process gas at an input pressure ($P_{in}$) and outlet duct 270 for expelling the process gas at an output pressure ($P_{out2}$). A casing 210 of the compressor 200 covers both the bearings and the seals and prevents the escape of gas from the compressor 200.

Compressor 200 also includes bearing 290. Bearing 290 may be located near the middle between the first and last impellers 230 and 239 in exemplary embodiments. The number of impellers 230-239 may be increased with the mid-span bearing according to exemplary embodiments than is currently possible for the additional reasons described herein further.

Currently, a limiting factor in the number of stages that can be included in a compressor is the ratio between the length and the diameter of a shaft. This ratio is referred to as the flexibility ratio. In order to operate effectively, a compressor may have a maximum flexibility ratio. This ratio can be increased with a longer shaft and a mid-span gas bearing according to exemplary embodiments.

The gas used in gas bearing 290 may be the gas being processed by compressor 200. The placement of gas bearing 290 may be at a location where the rotor displacement for a nearest natural frequency may be most pronounced. This location may be of optimal effectiveness from a rotor dynamic point of view.

The gas being processed may be "bled" from an output of an impeller that is "downstream" from gas bearing 290 using known elements/components and methods. The term downstream is used in this case as it relates to the direction of the gas flow and higher pressure in the case of compressors. That is, pressure is higher downstream and lower upstream relative to a particular location. For example, as illustrated in FIG. 2, gas bearing 290 is "upstream" relative to impeller 235 but is "downstream" relative to impeller 234.

The pressure of the working gas coming into bearing 290 has to be at a higher pressure than the pressure of the working gas in "bounding" or "adjacent" stages to the gas bearing so that the gas flow is out of the bearing pad and not into the bearing pads.

The working gas, therefore, has to be bled from a stage that is beyond the location of gas bearing 290. If bearing 290 is placed after five stages (i.e. impeller 234) for example, then the working gas has to be bled from a stage after the sixth stage (i.e. impeller 235). In one embodiment, the working gas may be bled from at least two stages downstream from the location of the mid-span gas bearing (i.e. after impeller 236). The high pressure is needed by bearing 290 to work in a stable manner.

The working gas that is bled from a downstream compression stage may be processed through filter 240 and provided to gas bearing 290 in some embodiments. Filter 240 may remove any impurities and particulates in the gas being processed. The rotor assembly may be flushed with gas via gas bearing 290 to remove heat from the assembly. The percent of working gas mass flow going to the bearing 290 may be less than 0.1% of the core flow.

Small bore channels may be provided between bearing 290 and the working flow path. The gas from bearing 290 may be lead into the flow path by the bore channel to the proper pressure.

An increase in the length of the shaft leads to an increase in a ratio of the length to the diameter of the compressor bundle/casing. This facilitates the addition of compression stages within the same casing.

Figure 3:
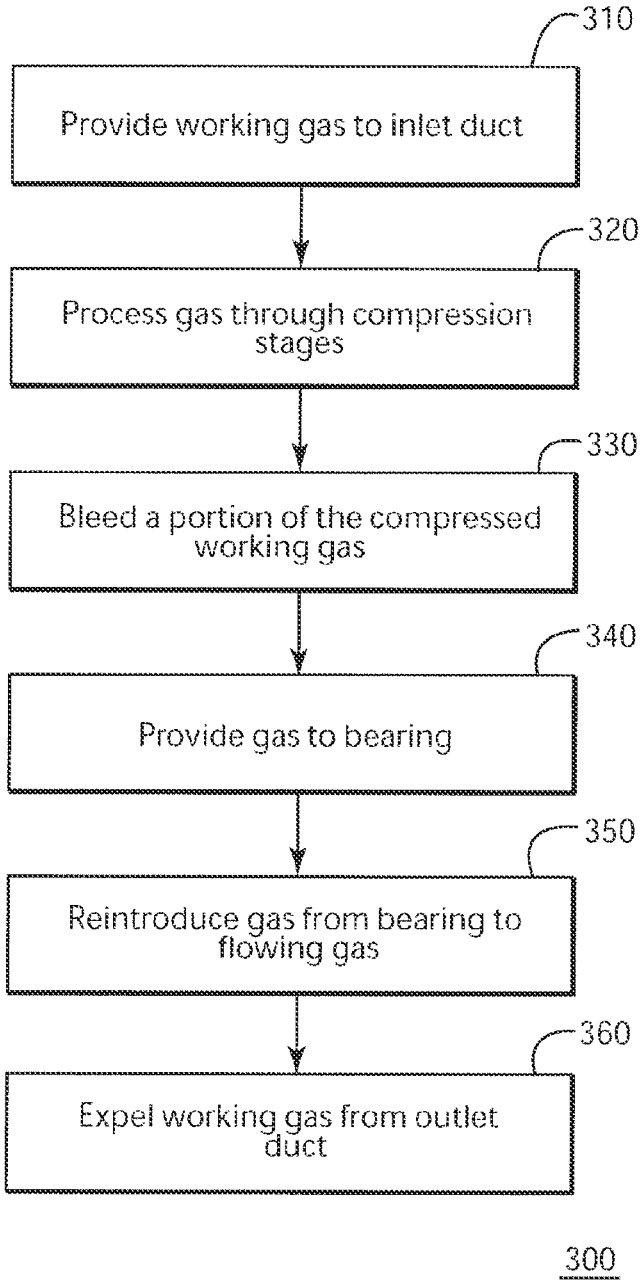
FIG. 3 illustrates a method in accordance with exemplary embodiments.

Thus, according to an exemplary embodiment, a method for processing a gas 300 through a multistage compressor having a mid-span gas bearing includes the method steps in the flowchart of FIG. 3. At 310, a working gas may be supplied to an inlet duct of a compressor. The working gas may be processed by a plurality of compression stages to increase the pressure (and speed) at 320. A portion of the working gas may be bled from its flow through the compression stages after it has been processed by a number of compression stages at 330. This number of stages may be greater than one half of the compression stages in the compressor.

The gas may be supplied to a gas bearing at 340 to flush and remove heat from the rotor assembly, the gas bearing being located upstream of the filter. The gas supplied to the gas bearing may be reintroduced into the flow of the working gas at 350. Gas from the final stage of compression may be expelled via the outlet duct at 360. In some embodiments, the gas that has been bled may be processed by a filter to remove any impurities before being provided to the gas bearing.

The number of mid-span gas bearings may be greater than one. Additional (or, multiple) mid-span gas bearings may be included in some embodiments utilizing the principles described above. Also, a mid-span bearing may not be exactly in the center—it may be offset depending on the particular design and specifications such as having an odd number of stages. Each of the multiple gas bearings may receive working gas from a separate impeller downstream.

If multiple gas bearings are implemented within a compressor, the number of (compression) stages between the input and the first of the gas bearings may be the same as the number stages between the last of the gas bearings and the output. The multiple gas bearings may also be spaced apart by the same number of stages. Therefore, the number of stages between the input and the first gas bearing may be the same as the number stages between the first and the second gas bearings (and between each of the subsequent gas bearings) which may also be the same as the number of stages between the last gas bearing and the output, etc.

A first of the gas bearings may receive compressed gas from a stage that is both downstream from the first gas bearing and upstream from a second of the gas bearings. That is, the first gas bearing may receive compressed gas from a stage that is between the first and the second gas bearings.

Those skilled in the art will appreciate that the specific number of impellers described above and illustrated in FIG. 2 are purely exemplary and that other number of impellers may be used. There may be a greater or a lesser number impellers depending on the application. The shaft may be a single shaft.

Exemplary embodiments as described herein provide multiple advantages over compressors that are in use at present. Additional impellers (and longer rotor assembly) may be placed within one casing as opposed to having a series of casings for increasing pressure. Efficiency within each casing (having longer rotor assembly for example) is increased as well. Space requirements for compressors to achieve a particular ratio of output pressure to input pressure are reduced. The flexibility ratio is increased to facilitate additional impellers.

Length (L2) of shaft 220 in compressor 200 (FIG. 2) according to exemplary embodiments is greater than the length (L1) of shaft 120 in compressor 100 (FIG. 1).

In addition, the use of gas bearings also obviates the need for elaborate sealing systems within the casing as oil does not enter the casing. The cost is also dramatically reduced as a result of the design as described.

The above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims. No element, act, or instruction used in the description of the present application should be construed as critical or essential to the invention unless explicitly described as such. Also, as used herein, the article "a" is intended to include one or more items.

The invention claimed is:

1. A centrifugal compressor, comprising:

a rotor assembly including a shaft and a plurality of impellers;

a pair of bearings located at ends of the shaft and configured to support the rotor assembly;

a sealing mechanism disposed between the rotor assembly and the bearings; and a first gas bearing disposed between the plurality of impellers and configured to support the shaft, the first gas bearing receiving a working gas from an impeller located downstream from a location of the first gas bearing, wherein downstream is relative to a direction of a flow of the working gas.

2. The centrifugal compressor of claim 1, wherein the first gas bearing is located at a point that is half way between the plurality of impellers in the compressor.

3. The centrifugal compressor of claim 1, wherein the first gas bearing is located at a point beyond a half way between the plurality of impellers in the centrifugal compressor.

4. The centrifugal compressor of claim 1, wherein the working gas is one of carbon dioxide, hydrogen sulfide, butane, methane, ethane, propane, liquefied natural gas, or a combination thereof.

5. The centrifugal compressor of claim 1, wherein the pair of bearings are oil bearings.

6. The centrifugal compressor of claim 5, wherein an operating surface speed of the first gas bearing is higher than an operating surface speed of the oil bearings.

7. The centrifugal compressor of claim 6, wherein the operating surface speed of the first gas bearing is at least twice the operating surface speed of the oil bearings.

8. The centrifugal compressor of claim 1, further comprising:

a filter for purifying the working gas before the working gas is received by the first gas bearing.

9. The centrifugal compressor of claim 1, further comprising:

a second gas bearing disposed between the plurality of impellers, wherein the second gas bearing is located downstream from the first gas bearing.

10. The centrifugal compressor of claim 1, wherein the working gas is received by the first gas bearing from an impeller that is one compression stage beyond the first gas bearing.

11. The centrifugal compressor of claim 1, wherein the working gas is received by the first gas bearing from an impeller that is at least two compression stages beyond the first gas bearing.

12. The centrifugal compressor of claim 1, wherein the working gas received by the first gas bearing is less than about 0.1% of the working gas flowing through the centrifugal compressor.

13. The centrifugal compressor of claim 1, wherein the shaft is a single shaft.

14. A method of processing a working gas in a centrifugal compressor, the method comprising:

providing the working gas to an inlet duct of the compressor;

processing the gas through a plurality of compression stages, each stage accelerating the speed of the gas;

bleeding a portion of the accelerated gas after a stage that is downstream from a midway point of the compression stages, wherein downstream is relative to a direction of a flow of the working gas;

providing the bled gas to a gas bearing located between the plurality of compression stages;

reintroducing the gas from the gas bearing to the working gas flowing in the compressor; and expelling the working gas from an outlet duct of the compressor.

15. The method of claim 14, further comprising:

filtering the gas that has been bled to remove impurities before providing the gas to the gas bearing.

16. The method of claim 14, further comprising:

flushing a rotor assembly of the compressor with gas from the gas bearing to remove heat from the rotor assembly.

17. A centrifugal compressor comprising:

a rotor assembly including a shaft and a plurality of impellers;

a pair of bearings located at ends of the shaft and configured to support the rotor assembly;

a sealing mechanism disposed between the rotor assembly and the pair of bearings; and a plurality of gas bearings disposed between the plurality of impellers and configured to support the shaft, wherein each of the plurality of gas bearings receives a working gas from a respective impeller located downstream from a location of the gas bearing, and wherein downstream is relative to a direction of a flow of the working gas.

18. The centrifugal compressor of claim 17, wherein a number of compression stages between an input of the compressor and a first of the plurality of gas bearings is equal to a number of compression stages between a last of the plurality of gas bearings and an output of the compressor.

19. The centrifugal compressor of claim 18, wherein a number of compression stages between each of the plurality of gas bearings is equal to the number of compression stages between the input and the first of the plurality of gas bearings.

20. The centrifugal compressor of claim 17, wherein a first of the plurality of gas bearings receives working gas from an impeller that is downstream of a first of the plurality of gas bearings and upstream of a second of the plurality of gas bearings.

* * * * *